US009839263B2

(12) United States Patent
Villa et al.

(10) Patent No.: US 9,839,263 B2
(45) Date of Patent: Dec. 12, 2017

(54) PRESSURE SNAP FASTENER WITH A BIVALENT CLOSURE

(71) Applicant: FIMMA S.P.A., Osnago (LC) (IT)

(72) Inventors: Angelo Villa, Osnago (IT); Riccardo Candotti, Osnago (IT)

(73) Assignee: FIMMA S.P.A., Osnago (LC) (IT)

( * ) Notice: Subject to any disclaimer, the term of this patent is extended or adjusted under 35 U.S.C. 154(b) by 0 days.

(21) Appl. No.: 14/082,167

(22) Filed: Nov. 17, 2013

(65) Prior Publication Data

US 2014/0137373 A1 May 22, 2014

(30) Foreign Application Priority Data

Nov. 16, 2012 (IT) ..... MI2012A1953

(51) Int. Cl.
*A44B 17/00* (2006.01)

(52) U.S. Cl.
CPC ..... *A44B 17/0052* (2013.01); *A44B 17/007* (2013.01); *A44B 17/0023* (2013.01); *A44B 17/0076* (2013.01); *Y10T 24/366* (2015.01)

(58) Field of Classification Search
CPC ..... A44B 17/0088; A44B 17/0052; A44B 17/0035; A44B 17/0076; A44B 17/0082; A44B 17/0029; A44B 17/00; A44B 17/0011; A44B 17/0023; A44B 17/0041; A44B 17/007; A41H 37/001; A44C 27/003; B29C 45/14
USPC ..... 24/107, 108, 572.1, 671, 681, 689
See application file for complete search history.

(56) References Cited

U.S. PATENT DOCUMENTS

| | | | | | |
|---|---|---|---|---|---|
| 1,732,837 | A | * | 10/1929 | Fenton | 24/681 |
| 1,832,830 | A | * | 11/1931 | Fenton | 24/681 |
| 2,129,825 | A | * | 9/1938 | Dews | 24/680 |
| 2,668,340 | A | * | 2/1954 | Jones | 24/681 |
| 2,683,908 | A | * | 7/1954 | Carpinella | 24/108 |
| 2,771,653 | A | * | 11/1956 | Carpinella | 24/681 |
| 2,799,910 | A | * | 7/1957 | Weber | 24/681 |
| 2,851,756 | A | * | 9/1958 | Jones | 24/692 |
| 3,229,343 | A | * | 1/1966 | Shears | 24/681 |
| 3,466,714 | A | * | 9/1969 | Nysten | 24/689 |
| 3,538,557 | A | * | 11/1970 | Hirose | 24/679 |
| 4,562,624 | A | * | 1/1986 | Kanzaka | 24/621 |
| 4,641,401 | A | * | 2/1987 | Hasegawa | 24/681 |
| 4,805,272 | A | * | 2/1989 | Yamaguchi | 24/623 |
| 4,847,959 | A | * | 7/1989 | Shimada et al. | 24/671 |
| 5,933,929 | A | * | 8/1999 | Kawakami et al. | 24/681 |
| 6,076,240 | A | * | 6/2000 | Henzler | 24/662 |
| 6,170,129 | B1 | * | 1/2001 | Pferdehirt | 24/108 |
| 6,199,248 | B1 | * | 3/2001 | Akashi et al. | 24/693 |

(Continued)

*Primary Examiner* — Robert Sandy
*Assistant Examiner* — David Upchurch
(74) *Attorney, Agent, or Firm* — Hedman & Costigan, P.C.; James V. Costigan; Kathleen A. Costigan

(57) ABSTRACT

A pressure snap fastener with a bivalent closure comprises a first portion, to be associated with a first flap, and a second portion, to be associated to a second flap; where the portions, as associated with one another join the flaps. The pressure snap fastener further includes first temporary engagement means providing a temporary closure, in which the two portions are joined by a weakly joining and are free of partially swinging, and include second stable engagement means, providing a stable closure, in which the two portions are tightly coupled.

8 Claims, 6 Drawing Sheets

(56) References Cited

U.S. PATENT DOCUMENTS

| | | | | |
|---|---|---|---|---|
| 7,157,152 | B2 * | 1/2007 | Urata et al. | 428/639 |
| 7,703,180 | B2 * | 4/2010 | Raccosta | 24/94 |
| 7,867,625 | B2 * | 1/2011 | Urata et al. | 428/639 |
| 8,572,821 | B2 * | 11/2013 | Hasegawa | 24/662 |
| 2006/0021198 | A1 * | 2/2006 | Raccosta | 24/104 |

* cited by examiner

PRESSURE SNAP FASTENER WITH A BIVALENT CLOSURE

BACKGROUND OF THE INVENTION

The present invention relates to a pressure snap fastener with a bivalent closure.

The field of the invention is that of the pressure snap fasteners, also called "automatic" snap fasteners, conventionally used for mutually clamping two portions or flaps, for example of a garment or other article in general usually made of a fabric, leather, paper, plastic sheet material or other light material.

Pressure snap fasteners usually comprise a male portion, to be clamped on a first flap to be coupled, and a female portion, integral with the other flap.

Each pressure snap fastener portion comprises an active element, providing either the male or female component of the coupling arrangement, and a further element for clamping said active element on the respective fabric, leather, paper and the like flap.

Prior pressure snap fasteners of the above discussed type have an open snap fastener condition and a closed snap fastener condition.

The latter condition provides the stable mutual latching or closure of the two article flaps.

However, it is also frequently necessary to provide a temporary closure of the two flaps, before the end closure, for example as a garment or bag must be closed by quick and simple closing operations, without requiring those effort and manual operations which are usually necessary to properly latch the pressure snap fastener.

Such a possibility, in fact, may be particularly useful as, for example, a bag must be temporarily closed, and for reopening it; or, in the garment field, as it is necessary to prevent complex manual operations from being performed for latching two garment flaps including many pressure snap fasteners.

SUMMARY OF THE INVENTION

Accordingly, the aim of the present invention is to provide a pressure snap fastener construction, with bivalent closure means, which, differently from prior pressure snap fasteners, allows to achieve, in addition to a first tight closure of the pressure snap fastener, also a temporary closure, of a less strength than the first one, and which temporary closure can also be carried out by closing operations much more easy, quick and simple than those required to provide the first tight closure.

Within the scope of the above mentioned aim, a main object of the invention is to provide such a bivalent closure pressure snap fastener having a compact structure, similar to that of a prior pressure snap fastener.

Another object of the present invention is to provide such a pressure snap fastener which, in comparison with a prior analogous pressure snap fastener, can also be applied on articles so shaped as to make difficult the operations to provide the closure of prior snap fasteners.

Yet another object of the present invention is to provide such a pressure snap fastener construction which can be made starting from easily commercially available elements and materials and which, moreover, is very competitive from a mere economic standpoint.

Yet another object of the present invention is to provide such a pressure snap fastener construction which, owing to its specifically designed structural features, is very reliable and safe in operation.

The above mentioned aim and objects, as well as yet other objects, which will become more apparent hereinafter, are achieved by a pressure snap fastener, with a bivalent closure, comprising a first portion, adapted to be associated with a first flap, and a second portion, adapted to be associated with a second flap; said first and second portions as associated to one another joining said flaps; said pressure snap fastener being characterized in that it further comprises first temporary engagement means, adapted to provide a temporary closure, in which said first and second portions are joined by a weak tightness joining and are free of partially swinging, and second stable engagement means, adapted to provide a stable closure, allowing said first and second portions to be tightly coupled.

BRIEF DESCRIPTION OF THE DRAWINGS

Further characteristics and advantages of the present invention will become more apparent hereinafter from the following disclosure of a preferred, though not exclusive, embodiment of the invention which is illustrated, by way of an indicative but not limitative example, in the accompanying drawings, where.

DESCRIPTION OF THE PREFERRED EMBODIMENTS

Figure 1:
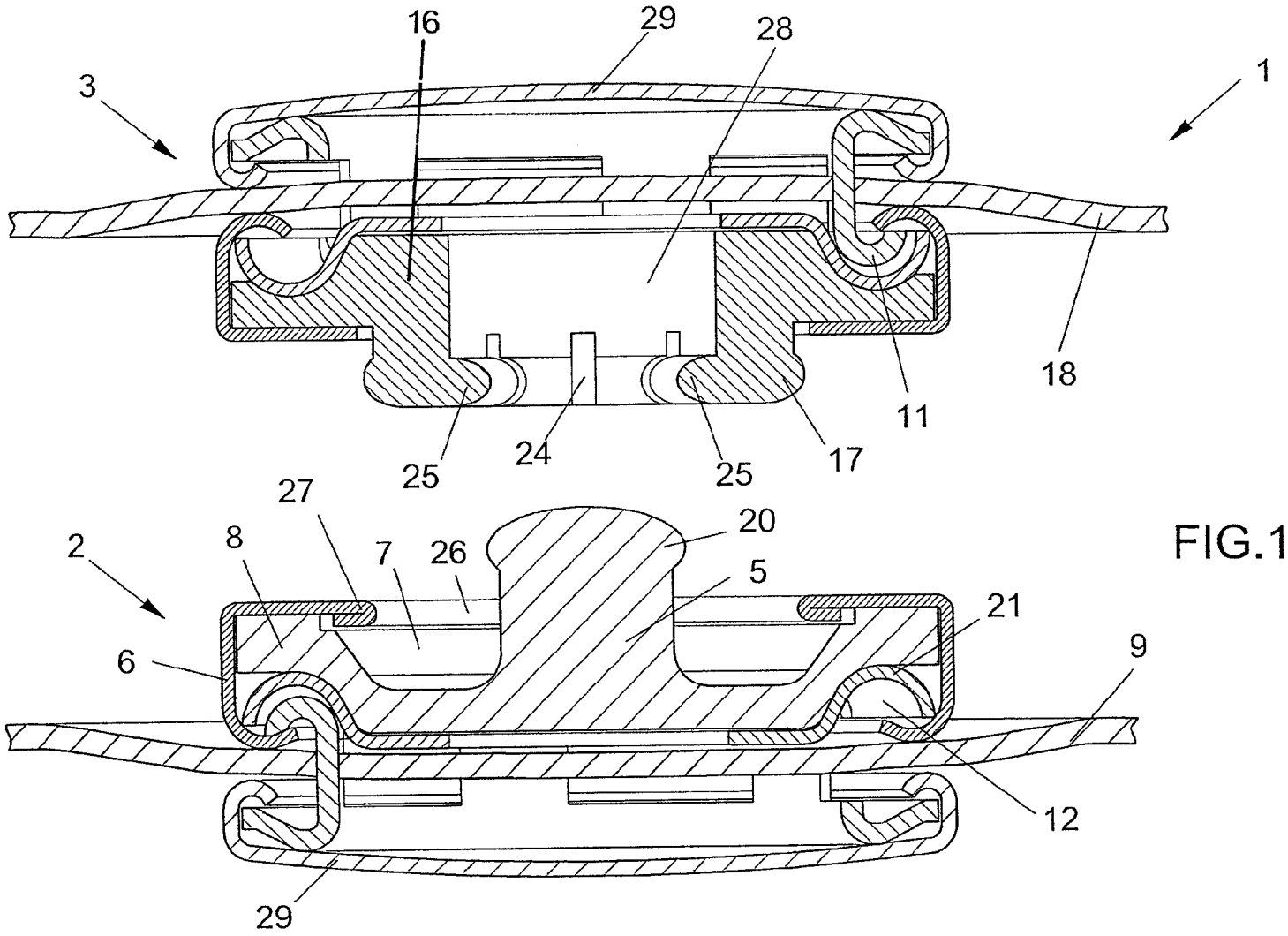
FIG. 1 is a cross-sectional view showing the inventive pressure snap fastener with its male and female components in a mutually detached condition, with the snap fastener being fully open and unlatched.

With reference to the number references of the above mentioned figures, the pressure snap fastener with a bivalent closure, according to the present invention, which has been generally indicated by the reference number 1, comprises a first snap fastener portion 2, which can be associated with a first flap 9, and a second snap fastener portion 3, which can be associated with a second flap 18.

Thus, said two snap fastener portions 2 and 3 can be joined to one another to connect said flaps 9 and 18.

More specifically, said flaps 9 and 18 can be part of a garment, a bag, or any other articles, and can be made of different materials, such as fabrics, leather materials and the like.

The pressure snap fastener according to the present invention comprises first temporary engagement means, providing a temporary closure, in which the two portions are joined by a weak joining, so as to partially swing, and second stable or firm engagement means, providing a stable or firm closure, in which the two parts are tightly joined.

Figure 9:
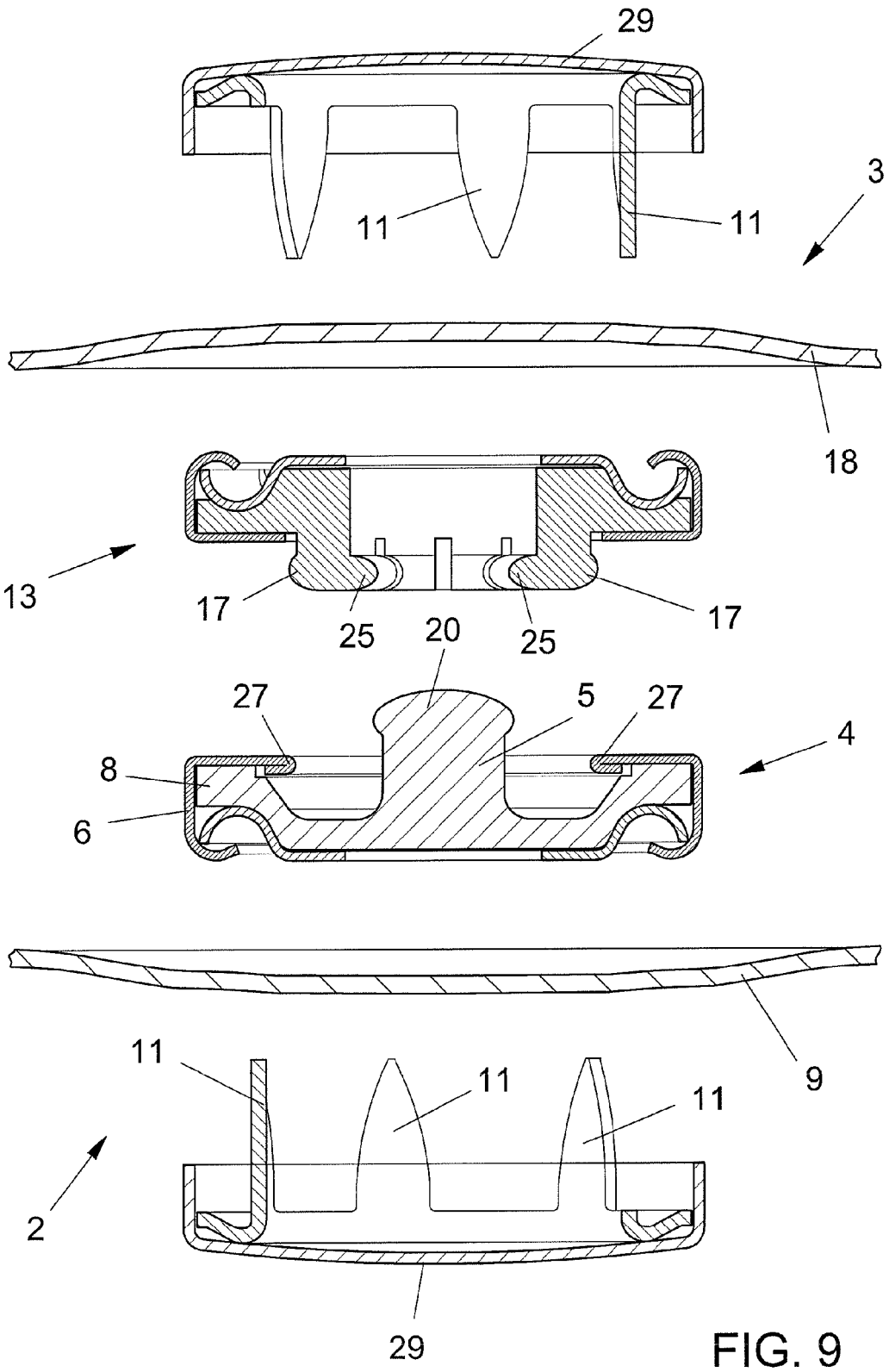
FIG. 9 is a partially exploded cross-sectional view showing the component parts forming the pressure snap fastener according to the present invention, before clamping it on flaps to which it must be connected.

As is clearly shown in FIG. 9, said first portion 2 comprises an active element 4, including an active element pin 5 having a pin head 20, enlarged in comparison with the diameter of said pin 5, and being integral with an advantageously disc-shaped body 8.

The active element 4 comprises moreover a cap 6 which, by cooperating with a groove 7 formed in the body 8, operates as an active female element of the second stable or firm closure means.

Said active element 4 is in turn clamped to the respective support or flap 9 by a head 10, comprising a crown of tip portions 11 adapted to be engaged in a corresponding recess or seat 12, formed in the body of the active element 4.

The joining of the first active element 4 to the first flap 9 can also be achieved by other riveting and the like systems, well known in this field.

The second portion 3 comprises a second active element 13, consisting of a body 14, having an axial inner hole 15, including a narrowed portion 25, and designed to operate as an active female element of the first temporary engagement means.

The body 14 comprises a cylindric pin 16, including a radial enlarged portion 17, and adapted to operate as an active male element of the second stable engagement means.

Advantageously, said cylindric pin 16 comprises cut-outs or notches 24, designed for facilitating a resilient deforming of said pin during the snap fastener closure operations or steps.

More specifically, said cut-outs or notches 24 operate, in a temporary closure operation, for facilitating the enlargement of the hole 15 engaging therein the head portion 20 of the pin 5 of the active element 4 of the pressure snap fastener.

In the stable closure or closing operation, said cut-outs 24 facilitate a narrowing of the pin 16 of the active element 13 as the latter is engaged in a hole 26 of the cap 6, being counter-biased by its tightness edge portion 27.

Thus, as the depth of said cut-outs and the interference effect between the enlarged or bulged portion of the pin and the tapering portion of the female element change, the tightness of the assembly will correspondingly change, to allow the enlarged portion 17 of the pin 16 of the active element 13 to pass over the tightness edge portion 27 of cap 6 of the active element 4.

In the stable closing operation, the smaller diameter of the pin 5 of the first active element will be advantageously sufficiently smaller than the diameter of the hole 15 of the second active element 13.

Figure 2:
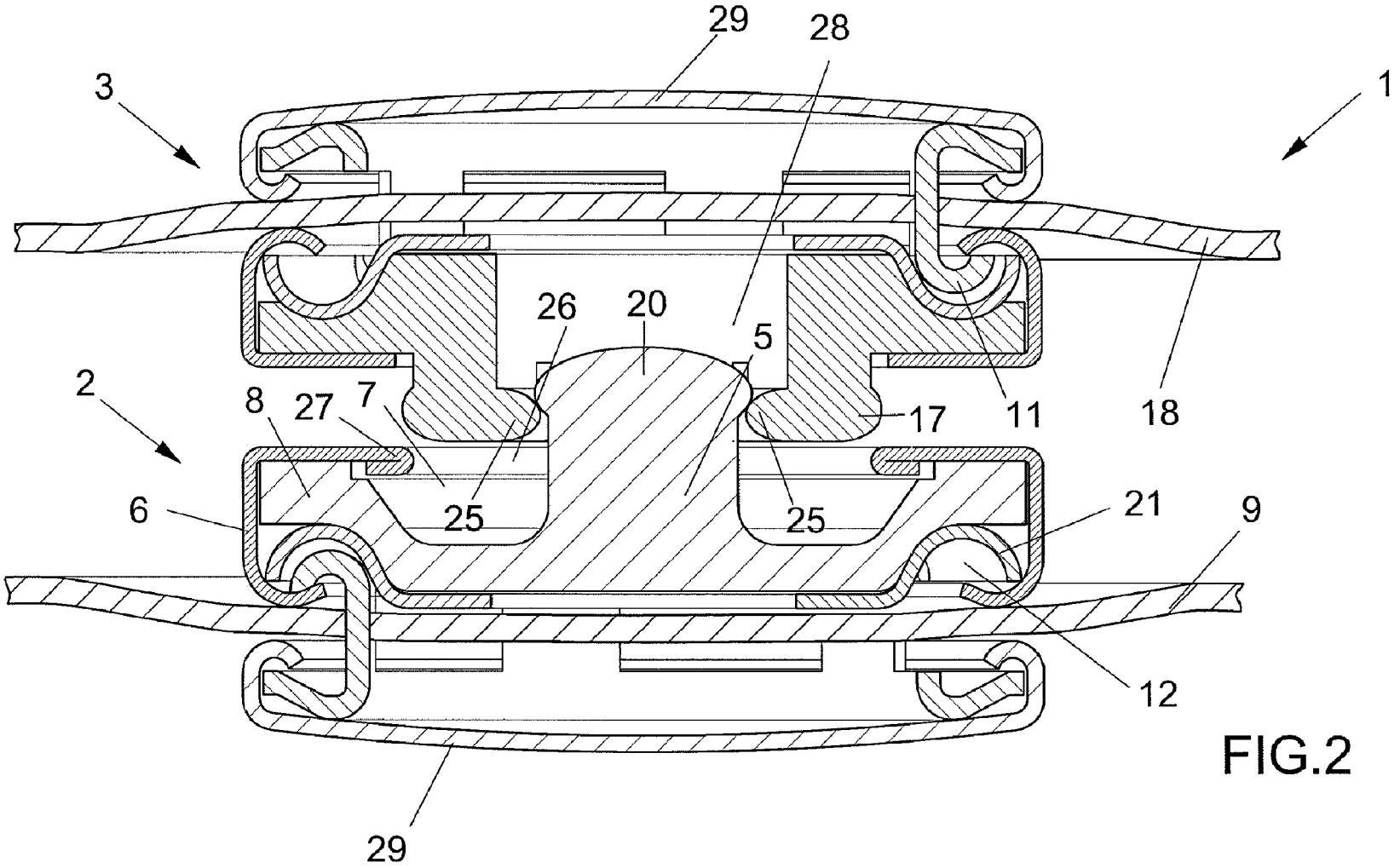
FIG. 2 is a cross-sectional view showing the pressure snap fastener of FIG. 1, in a temporary closure position thereof.

Thus, a space 28 will be left, allowing the section of the pin 16 to be freely narrowed, as said pin 16 is caused to pass through the hole 26 of the active element 4, as clearly shown in FIGS. 2 and 9.

The second active element 13 will be clamped to the second support flap 18 by a head portion 19, fully analogous to the above disclosed head portion 10.

Figure 4:
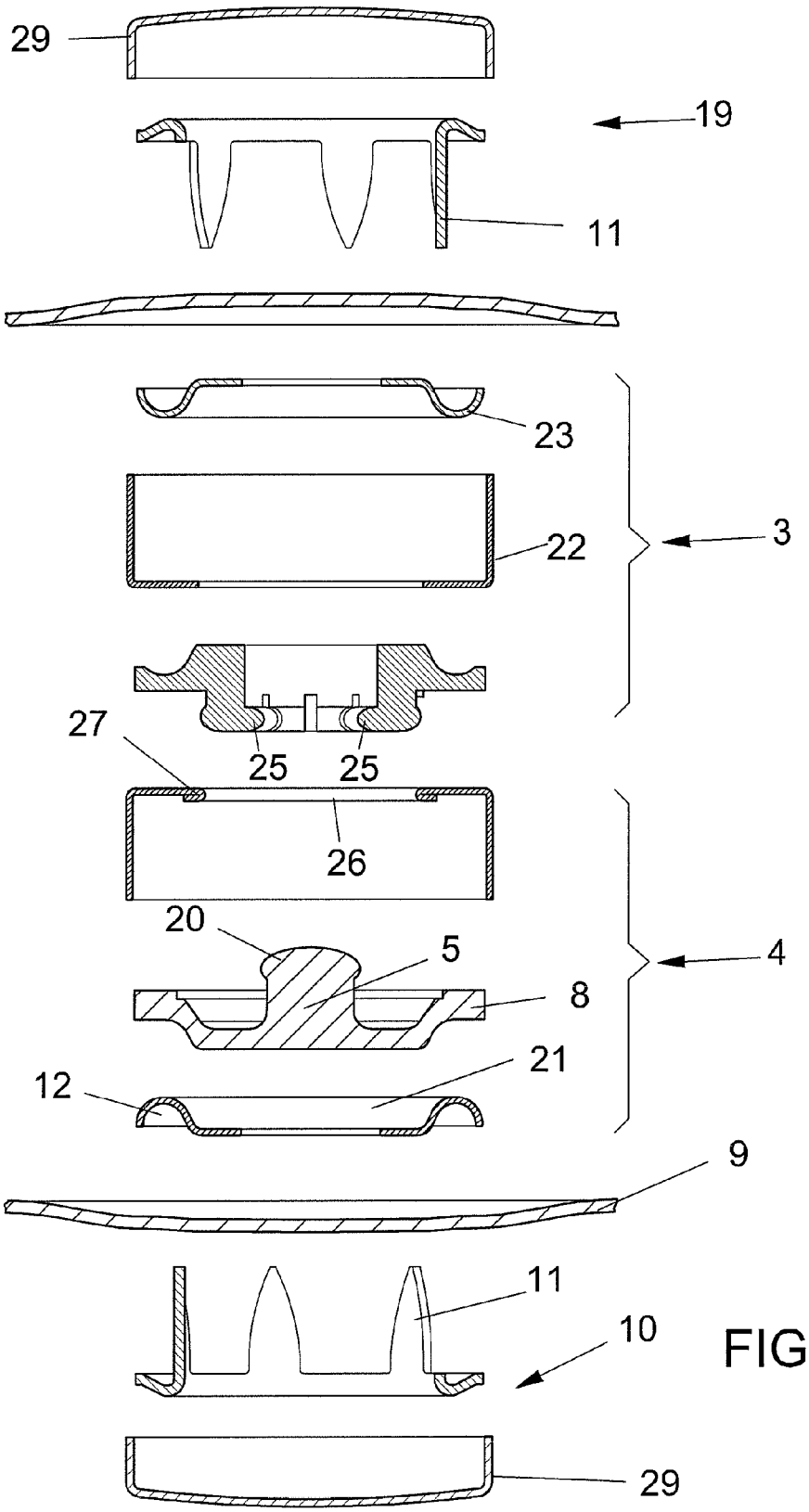
FIG. 4 is an exploded cross-sectional view of the pressure snap fastener according to the present invention.
Figure 5:
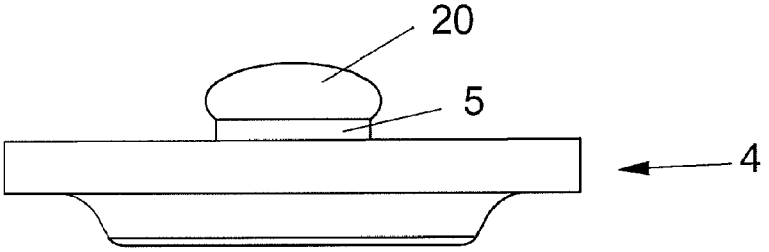
FIGS. 5 and 6 show in a side view and a perspective view, respectively, the active male-female element of the male portion of the pressure snap fastener of the preceding Figures.
Figure 6:
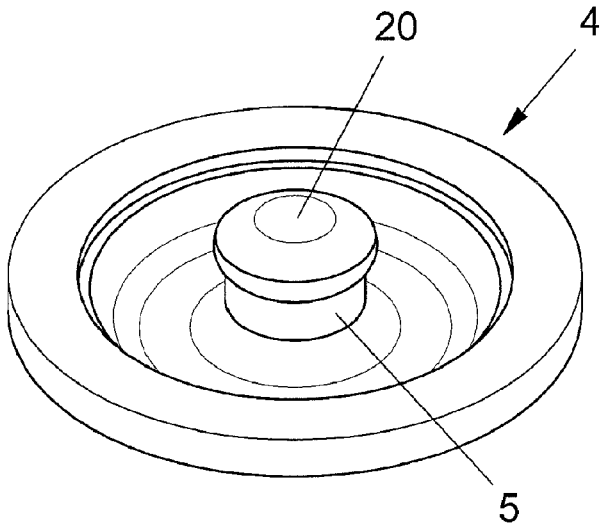
Figure 7:
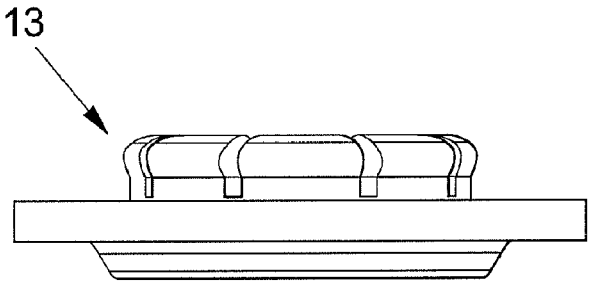
FIGS. 7 and 8 show in a side and a perspective view, respectively, the active female-male element of the female portion of the pressure snap fastener of the preceding Figures.
Figure 8:
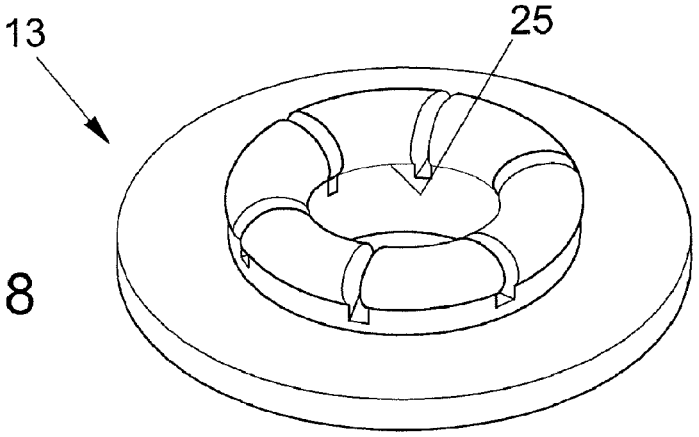

Moreover, as clearly shown in FIG. 4, the active element 4 of the male portion 2 can further comprise a contoured washer element 21 including a corresponding seat or recess 12 for the tip portions 11 of the head 10.

The second active element 13 of the second portion 3 comprises a corresponding cap 22 and a respective contoured or shaped washer element 23.

The above disclosed clamping elements for clamping a support and pressure snap fastener according to the present invention can also comprise other clamping devices, depending on the article to which the inventive snap fastener has to be riveted or affixed.

In operation, the pressure snap fastener 1 according to the present invention will provide, in a properly operating succession, two different closure or closing arrangements, that is a temporary closure and a stable closure.

In said temporary closure, or weak latching or joining, as shown in FIG. 2, the pin 5 of the first active element 4 of the first portion 2 will engage, under a minimum effort, in the axial inner hole 15 of the second active element 13 of the second portion 3.

The mechanical tightness or clamping of this temporary closure is deliberately a weak one thereby allowing the two portions to partially mutually swing, since the head 20 of the pin 5 can swing in the hole 15, advantageously in cooperation with the narrowed portion 25, providing a projection of the inner edge part of the hole 15 of the pin 16, as clearly shown in FIG. 4.

Figure 3:
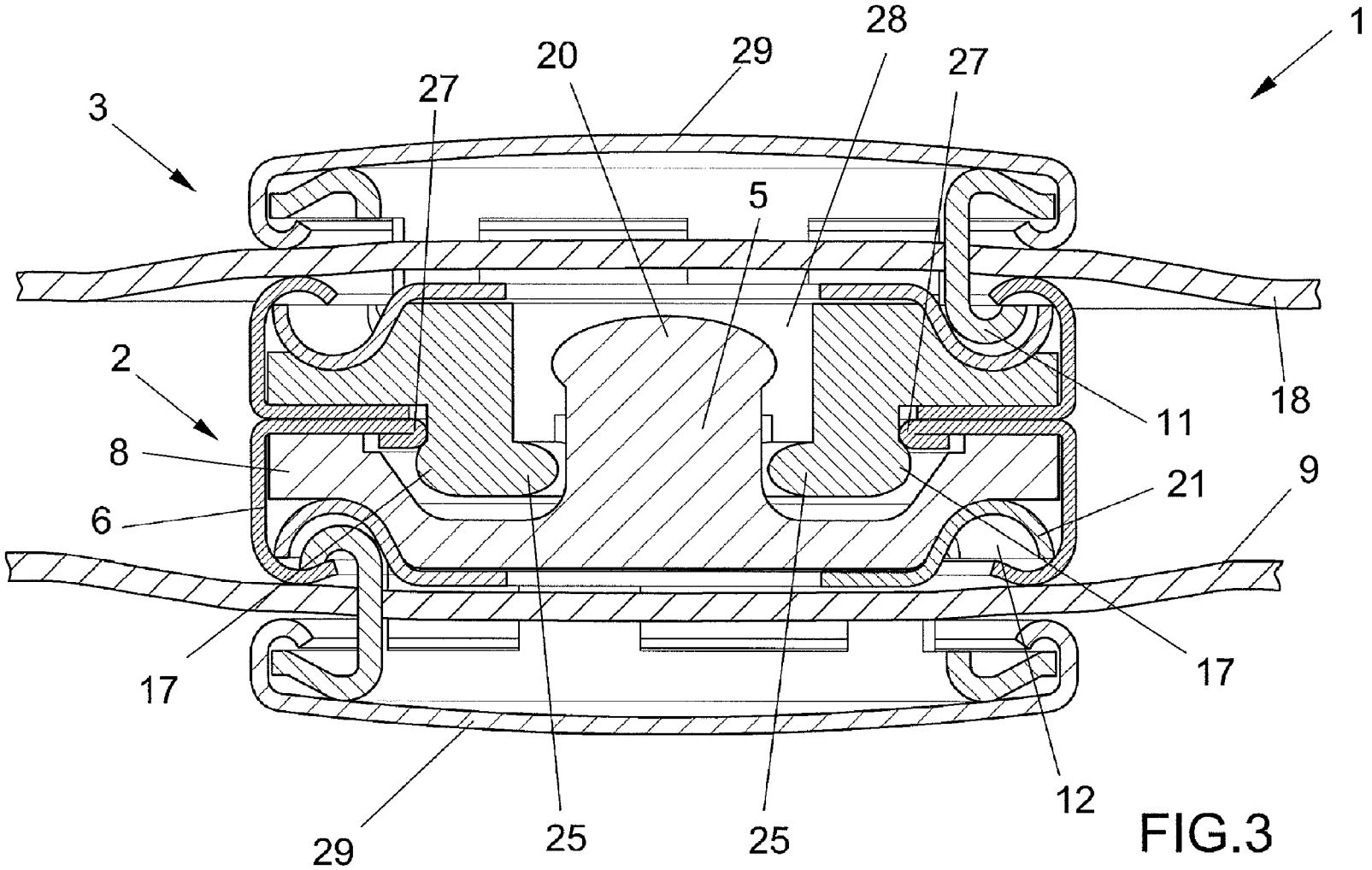
FIG. 3 is yet another cross-sectional view showing the pressure snap fasteners of the preceding Figures in a full closure condition or position thereof.

In the stable closure, or tight latching or coupling, as shown in FIG. 3, the pin 16 of the second active element 13 of the second female portion 3 will be engaged, with the required pushing pressure force, within the hole 26 of the cap 6 of the first active element 4, so as to engage in the groove 7 of the body 8 being counter-biased by its enlarged portion 17 on the tightness edge 27 of the same crown 6.

Thus, in operation, the operator can achieve, without an excessive effort and by very simple and quick operations, a first temporary closure, wherein the two supports or flaps 9 and 18 are at the start held slightly engaged at a close distance.

Then, for providing a stable and definitive latching, it will be sufficient to provide a further pressure for achieving the following end closure, joining the flaps 9 and 18 in a conventional manner for the disclosed type of snap fastener, with a clamping force much greater than that of the first closure or slight latching.

To provide the pressure snap fastener 1 with improved aesthetic characteristics, the pin 5 and cap 6 of the active element 4, the body 14 and the cap 22 of the active element 13, can be made of different materials and/or colored arrangements.

Moreover, according to possible modified embodiments of the invention, the heads 10 and 19 can also be clamped to their respective active elements 4 and 13 by other means than the mentioned tip portions 11, cap 22 and contoured washer elements 21 and 23.

It has been found that the invention fully achieves the intended aim and objects.

In fact, the invention has provided a pressure snap fastener which, in comparison with prior like snap fasteners, has the advantage that it allows a first closure, or temporary closure or latching, of the two portions forming it to be achieved.

Such a closure or closing operation can be carried out in a very quick, simple manner, without any excessive closure effort, thereby greatly simplifying the closure operations conventionally required for such a type of pressure snap fastener.

Accordingly, said snap fastener can be latched, though in a temporary manner, and with a minimum effort, by using only one hand, while having the possibility of performing a further end closure, of larger effort and identical to that which is conventionally used in prior pressure snap fasteners.

A further advantage of the invention is that it allows to use pressure snap fastener closures also on articles which usually, because of their shape or arrangement, would render difficult such an application, for example because of a lack of the space necessary to perform the latching operations, or because of a difficulty in providing the required counter-forces against the mutual closure joining of the two snap fastener portions.

Yet another advantage of the invention is that it allows the components of the snap fastener portions exposed to the view to be made with different colors and materials, thereby improving the aesthetic properties of the overall garment article.

Differently from prior snap fasteners, in which a portion is a male one and the other is a female one, in the pressure snap fastener according to the present invention the first portion 2 operates as a male portion in the temporary closure, while providing a function of the female portion in the stable closure condition.

Vice versa, the second portion 3 operates as the female portion in the temporary closure and as the male portion in the stable closure condition.

In practicing the invention, the used materials, as well as the contingent size and shapes can be any, depending on requirements.

The invention claimed is:

1. A pressure snap fastener with a bivalent closure, comprising a first portion, comprising a first active element adapted to be associated with a first flap, and a second portion, adapted to be associated with a second flap; said first and second portions as associated with one another joining said first and second flaps; said pressure snap fastener being characterized in that it further comprises first temporary engagement means, adapted to provide a first temporary closure, in which said first and second portions are joined by a weak joining and are free of partially swinging, and second stable engagement means, adapted to provide a second stable closure, allowing said first and second portions to be tightly coupled wherein said first active element includes a first active element pin having a pin head, enlarged in comparison with a diameter of said pin, and fastened to a disc-shaped body, said first active element comprising moreover a first active element cap which, by cooperating with a groove of said disc-shaped body, operates as an active female element of the second stable closure means; wherein said second portion comprises a second active element formed by a body including an axial inner hole having a narrowed portion comprising an inner edge and adapted to operate as an active female element of the first temporary engagement means, said body comprising a cylindric pin having a radial enlarged portion and operating as an active male element of the second stable engagement means; wherein said cylindric pin comprises a plurality of cut-outs, facilitating a resilient deforming of said cylindric pin in performing closure operations; said cut-outs operating, in a temporary closure operation, for facilitating an enlargement of the axial inner hole for engaging therein the head of the first active element pin; in a stable closure operation, said cut-outs facilitating a narrowing of said cylindric pin of said second active element as said second active element is engaged in a hole of said a first active element cap, being counter-biased by a tightness edge of said hole of said first active element cap; wherein said first active element pin has a minimum diameter which is sufficiently smaller than a diameter of an inner axial hole of said second active element thereby leaving a space allowing said cylindric pin cross-section to be narrowed as said cylindric pin is caused to pass through the hole of the first active element; wherein said first active element is clamped to said first flap by a first clamping head, comprising a cap including a plurality of tip portions engaging in a corresponding seat formed on the first active element.

2. A pressure snap fastener, according to claim 1, characterized in that said pressure snap fastener comprises a first snap fastener portion adapted to be associated with a first flap and a second snap fastener portion adapted to be associated with said second flap, said first and second snap fastener portions, as associated with one another, joining said first and said second flaps.

3. A pressure snap fastener, according to claim 2, characterized in that said first active element is clamped to said first support flap by a first clamping head, comprising a crown of tip portions for engaging in a corresponding seat formed on said disc body of said first active element, the joining of said first active element to said first flap being performed by riveting systems.

4. A pressure snap fastener, according to claim 3, characterized in that, in a stable closure operation, a depth of said cut-outs which facilitate a narrowing of said cylindric pin of said second active element, as the latter is engaged in said hole of said first active element cap under a counter-biasing provided by a hole tightness edge portion, is changed and an interference level between the enlarged pin portion and a tapering portion of said second active element, the tightness of said snap fastener is changed, to allow said radial enlarged portion of said cylindric pin of said second active element to pass over a tightness edge of the cap of the first active element.

5. A pressure snap fastener, according to claim 4, characterized in that, in a stable closure operation, wherein the first active element pin having a minimum diameter which is sufficiently smaller than a diameter of said axial inner hole of the second active element, leaves a space that allows a cross section of the first active element pin to freely swing after said first active element pin is caused to pass through said inner axial hole of said second active element.

6. A pressure snap fastener, according to claim 5, characterized in that a clamping of the second active element to said second support flap is performed by a second clamping head having tip portions, wherein said second clamping head is analogous to said first clamping head and said male active element of said second stable engagement means further comprises a contoured washer element including a seat for said tip portions of said second clamping head, said second active element of said second portion comprising a corresponding cap and a respective contoured washer element therefor.

7. A pressure snap fastener, according to claim 6, characterized in that in performing a temporary closure or weak latching, said first active element pin of the first portion engages, under a minimum effort, in the axial inner hole of the second active element of the second portion, such a temporary closure providing a weak mechanical tightness thereby allowing said first and second portions to partially mutually swing, by causing said pin head of said first active element pin to swing in said axial inner hole, with a cooperation of a narrowed portion providing a projection of the inner edge of said axial inner hole.

8. A pressure snap fastener, according to claim 7, characterized in that in performing a stable closure or latching operation, the cylindric pin of said second active element of said second female portion is engaged, under a pushing pressure, in said hole of said first active element cap, by engaging in a groove of the said disc-shaped body of said first active element and being counter-biased by an enlarged portion on a tightness edge of said hole of said first active element cap.

* * * * *